US007060152B2

(12) United States Patent
Kim

(10) Patent No.: US 7,060,152 B2
(45) Date of Patent: Jun. 13, 2006

(54) METHOD OF FABRICATING ELECTRODE OF PLASMA DISPLAY PANEL USING PHOTO-PEELING METHOD

(75) Inventor: Soon Hak Kim, Namyul-si (KR)

(73) Assignee: LG Electronics Inc., Seoul (KR)

( * ) Notice: Subject to any disclaimer, the term of this patent is extended or adjusted under 35 U.S.C. 154(b) by 8 days.

(21) Appl. No.: 10/657,258

(22) Filed: Sep. 9, 2003

(65) Prior Publication Data

US 2005/0076999 A1 Apr. 14, 2005

(30) Foreign Application Priority Data

Sep. 12, 2002 (KR) ..... 10-2002-0055416

(51) Int. Cl.
*H01J 9/02* (2006.01)
*H01J 9/14* (2006.01)
*H01J 17/04* (2006.01)

(52) U.S. Cl. ..... 156/247; 445/24; 430/256; 430/257; 430/313

(58) Field of Classification Search ..... 156/230, 156/233–235, 240, 241, 247, 277, 272.2, 156/273.3, 289, 275.1, 67; 427/146–151, 427/96; 438/455, 458, 584, 602, 652, 660, 438/674, 677; 430/25–28, 195, 198, 256, 430/257–262, 317–320, 311–313, 315, 325, 430/15; 428/411.1, 914; 313/582–587, 313/489, 116, 117, 169.4, 282, 238; 345/60; 445/24, 58

See application file for complete search history.

(56) References Cited

U.S. PATENT DOCUMENTS

| | | | | |
|---|---|---|---|---|
| 6,156,433 | A * | 12/2000 | Hatori et al. | 428/411.1 |
| 6,238,829 | B1 * | 5/2001 | Seki | 445/24 |
| 2005/0153058 | A1 * | 7/2005 | Tachikawa et al. | 445/24 |

FOREIGN PATENT DOCUMENTS

| | | | |
|---|---|---|---|
| JP | 08-167373 | * | 6/1996 |
| JP | 08-273535 | * | 10/1996 |
| JP | 09-092141 | * | 4/1997 |
| JP | 09-147751 | * | 6/1997 |
| JP | 2000-294121 | | 10/2000 |
| KR | 2001-004365 | | 1/2001 |

* cited by examiner

*Primary Examiner*—Sue A. Purvis
(74) *Attorney, Agent, or Firm*—Fleshner & Kim, LLP

(57) ABSTRACT

There is disclosed a method of fabricating electrodes of plasma display panel using photo-peeling method, which can make the electrode highly precise in correspondence to high resolution.

A method of fabricating an electrode of a plasma display panel using a photo peeling method according to an embodiment of the present invention includes the steps of forming a photo material layer on a substrate, the adhesive strength of the photo material layer decreases when exposed to light; exposing the photo material layer to light in correspondence to a desired pattern; forming an electrode material layer on the exposed photo material layer; forming a peeling material layer on the electrode material layer, the peeling material layer has higher adhesive strength than an exposure area of the photo material layer; and taking off the peeling material layer to pattern the electrode material layer.

12 Claims, 5 Drawing Sheets

METHOD OF FABRICATING ELECTRODE OF PLASMA DISPLAY PANEL USING PHOTO-PEELING METHOD

This application claims the benefit of the Korean Patent Application No. P2002-55416$_2$, filed on Sep. 12, 2002, the disclosure of which is hereby incorporated by reference.

BACKGROUND OF THE INVENTION

1. Field of the Invention

The present invention relates to a plasma display panel, and more particularly to a method of fabricating electrodes of plasma display panel using a photo-peeling method, which can make the electrode highly precise in correspondence to high resolution. Further, the present invention relates to a method of fabricating electrodes of plasma display panel using a photo-peeling method that is environment-friendly, with which it is easy to recycle materials and that is capable of reducing cost when forming the electrodes of the plasma display panel.

2. Description of the Related Art

A plasma display panel (hereinafter, PDP) displays a picture by exciting phosphorus to emit light ultraviolet ray generated when an inert mixture gas such as He+Xe, Ne+Xe, or He+Xe+Ne discharges electricity. The PDP can not only be easily made into a thinner and high definition large-scaled screen, but also improves in its quality due to the recent technology development.

Ref erring to FIG. 1, a discharge cell of three electrode AC surface discharge PDP includes a pair of sustain electrodes having a scan electrode Y and a sustain electrode Z formed on an upper substrate 1, and an address electrode X formed on a lower substrate 2 crossing the sustain electrode pair perpendicularly. Each of the scan electrode Y and the sustain electrode Z includes a transparent electrode and a metal bus electrode formed on top of it. An upper dielectric substance 6 and an MgO protective layer 7 are deposited on the upper substrate 1 provided with the scan electrode Y and the sustain electrode Z. A lower dielectric layer 4 is formed on the lower substrate 2 provided with the address electrode X, to cover the address electrode X. Barrier ribs 3 are perpendicularly formed on the lower dielectric layer 4. Phosphorus 5 is formed on the surface of the lower dielectric layer 4 and the barrier ribs 3. An inert mixture gas, such as He+Xe, Ne+Xe, or He+Xe+Ne, is injected into a discharge space provided between the upper substrate 1 and the lower substrate 2 and the barrier ribs 3. The upper substrate 1 and the lower substrate 2 are bonded together by a sealant (not shown).

Scan signals are applied to the scan electrode Y to select scan lines. And sustain signals are alternately applied to the scan electrode Y and the sustain electrode Z to maintain the discharge of the selected cells. Data signals are applied to the address electrode X to select cells.

The metal bus electrode of the scan electrode Y and the sustain electrode Z needs to have its width as narrow as it can be within the scope where line resistance is not too much high because it intercepts light from phosphorus to deteriorate brightness as much. Such a metal bus electrode is made by depositing a metal layer with three-layered structure of Cr/Cu/Cr on the transparent electrode by a vacuum deposition method and then patterning the metal layer by photolithography and etching process.

The address electrode X is formed on the lower substrate 2 by a pattern print method where silver Ag paste is printed on the lower substrate 2 through a screen after the screen for patterning is printed on the lower substrate 2, or by a photo method including photolithography and etching process after the silver paste is printed on the lower substrate 2.

However, there is the following problem with the pattern print method and photo method. The pattern print method has an advantage in that the process is relatively simple and the metal electrode can be formed at low cost, but it has two disadvantages. First, it is difficult to use the method for large size and high precision which are required for high resolution of PDP because the electrode width cannot be smaller than a given limit. Second, material such as volatile solvent, which is harmful to humans, has to be used because the material has to be in a state of paste. When compared to this, the photo method has an advantage in that it can be applied to large size and high precision because a relatively small electrode pattern can be formed, but it too has two disadvantages. First, it is not environment-friendly because the material is in the state of paste, and, second, the material is wasted and its cost is high because the entire surface of the substrate has to be printed with the material in paste.

Accordingly, it is an object of the present invention to provide a method of fabricating electrodes of PDP using a photo peeling method, by which the electrode can be made highly precise according to high resolution.

It is another object of the present invention to provide a method of fabricating electrodes of PDP using a photo peeling method that is environment-friendly, with which it is easy to recycle materials and that is capable of reducing cost when forming the electrodes of the plasma display panel.

In order to achieve these and other objects of the invention, a method of fabricating an electrode of a plasma display panel using a photo peeling method according to an aspect of the present invention includes the steps of forming a photo material layer on a substrate, wherein the adhesive strength of the photo material layer decreases when the photo material is exposed to light; exposing the photo material layer to light according to a desired pattern; forming an electrode material layer on the exposed and unexposed areas of the photo material layer; forming a peeling material layer on the electrode material layer, wherein the peeling material layer has higher adhesive strength for the electrode material than area of the photo material layer has for the electrode material; and the peeling material layer to leave the desired pattern of the electrode material layer on the unexposed areas of the photo material layer.

In the method, the exposed area of the electrode material layer is removed when removing the peeling material layer.

The method further includes the step of firing the remaining area except where the electrode material layer was removed by the peeling material layer.

The photo material layer includes binder of 20~50 wt %; reactive monomer of 40~70 wt %; photo initiator of 2~5 qt %; and additive of 2~5 wt %.

In the method, the binder includes at least one of polyurethane, polyester, polyacrylate, co-polymer with carboxylic -COOH and radical OH or tri-polymer with carboxylic -COOH and radical OH.

In the method, the reactive monomer includes at least one of a multi-functional monomer with 2~5 reactive radicals, acrylic monomer or urethane monomer and oligomer.

In the method, the photo initiator includes at least one of 1-hydroxy-cyclochexyl-phenyl ketone, p-pheny benzo phenone, benzyldimethylketal, 2,4-dimethylthioxanthone, 2,4-diethylthioxanthone, benzoin ethyl ether, benzoin isobutyl ether, 4,4' diethylaminobenzo-phenone, p-dimethyl amino benzoic acid ethylester.

In the method, the additive includes at least one of dispersing agent, stabilizer and polymerization prohibiting agent.

The electrode material layer includes silver Ag powder of 90~99 wt %; and glass-frit of 1~10 wt %.

The peeling material layer includes binder of 70~80 wt %; and additive of 20~30 wt %.

In the method, the binder includes at least one of polyurethane, polyester, polyacrylate, co-polymer with radical OH or tri-polymer with radical OH.

In the method, the additive includes at least one of dispersing agent, stabilizer and polymerization prohibiting agent.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

With reference to FIGS. 2A to 3F, embodiments of the present invention will be explained as follows.

Figure 1:
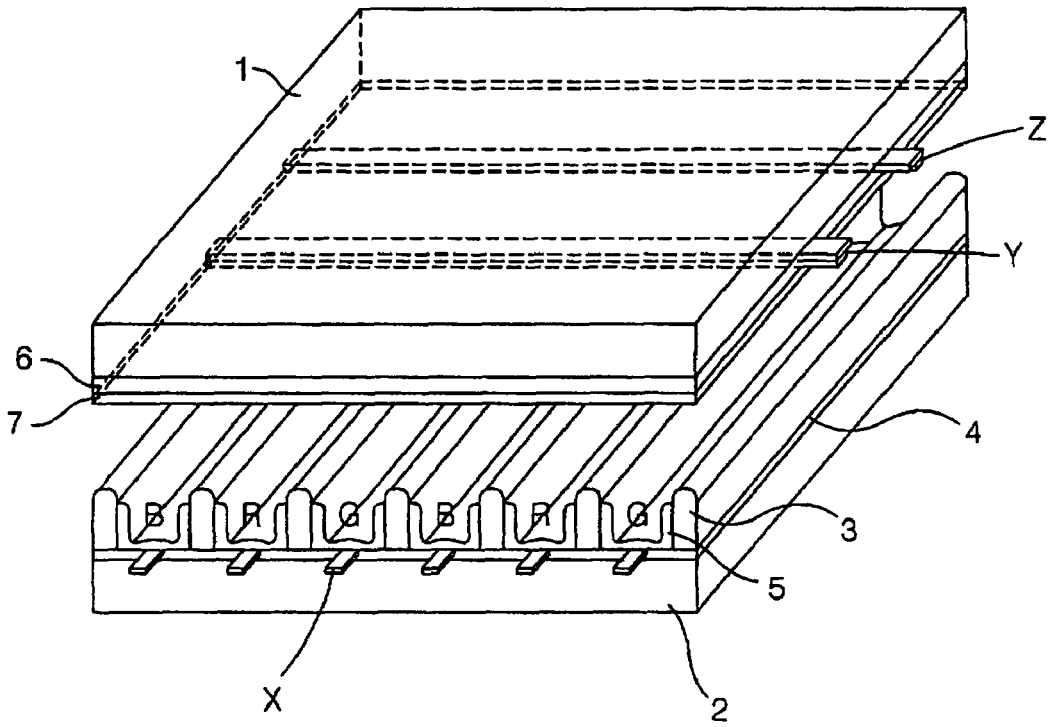
FIG. 1 RELATED ART
FIG. 1 is a perspective view representing a discharge cell structure of a conventional three-electrode AC surface discharge plasma display panel.
Figure 2A:
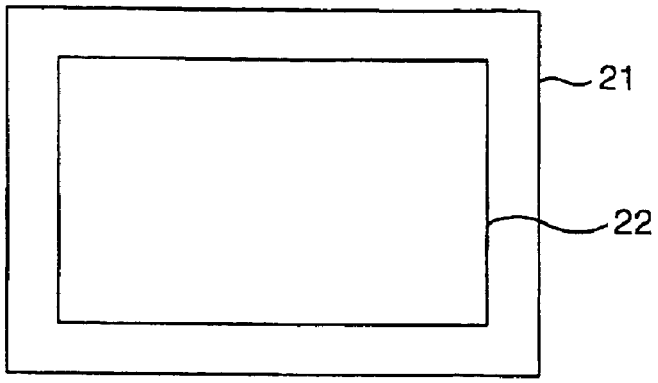
FIGS. 2A to 2F are top views of a fabricating method of a plasma display panel step by step according to an embodiment of the present invention.
Figure 2B:
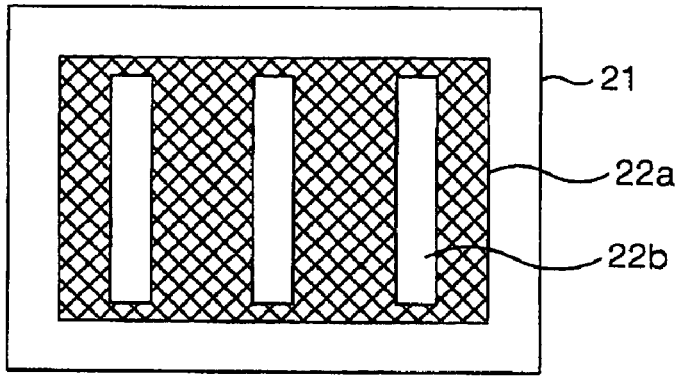
Figure 3A:
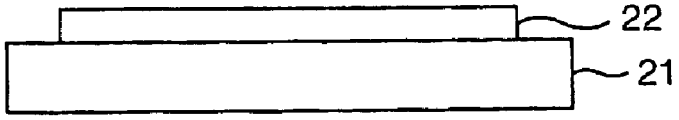
FIGS. 3A to 3F are side views of a fabricating method of a plasma display panel step by step according to an embodiment of the present invention.

Referring to FIGS. 2A and 3A, in a method of fabricating electrodes of a PDP according to an embodiment of the present invention, first of all, photo dry film resist (hereinafter, referred to as 'photo-DFR') 22 is formed on the entire surface of a substrate 21 by use of a laminating process.

The photo-DFR 22 is composed as the below table 1, thus it has a strong adhesive strength with the substrate 21, and if it is exposed to light in the following exposure process, it becomes stiff by the cross linkage of reactive monomer to lose its adhesive strength.

TABLE 1

| Binder | Reactive Monomer | Photo initiator | Additive |
|---|---|---|---|
| 20~50 wt % | 40~70 wt % | 2~5 wt % | 2~5 wt % |

A binder can be an organic substance such as polyurethane, Poly-ester, poly-acrylate and so on, and compound with carboxylic -COOH at the end of co-polymer or tri-polymer.

Photo-reactive monomer react with radical to be combined in chain shape and it possible to select a multi-functional monomer with 2~5 reactive radicals, or it can be chosen from acrylic or urethane monomer or oligomer. The multi-functional monomer or oligomer can be selected from the groups of multi-functional monomer such as ethyleneglycol diacrylate, diethyleneglycol diacrylate, methylene bisacrylate, propylene diacrylate, 1,2,4-butanetriol triacrylate, 1, 4-benzenediol diacrylate, trimethylol triacrylate, trimethylol trimethacrylate, pentaerythritol tetraacrylate, pentaerythritol tetramethacrylate, dipentaerythritol hexaacrylate and dipentaerythritol hexamethacrylate, and multi-functional oligomer such as melamine acrylate, epoxy acrylate, urethane acrylate, polyester acrylate, polyethylene glycol bisacrylate with its molecular weight between 200 to 500, polypropylene glycol bismethacrylate with its molecular weight between 200 to 500. Ebecryl 600, 605, 616, 639 and 1608 made by UCB Company are commonly used as epoxy acrylate oligomer. Ebecryl 264, 265, 284, 8804 are commonly used as aliphatic urethane acrylate oligomer. Ebecryl 220, 4827 and 4849 are commonly used as aromic urethane acrylate oligomer. Ebecryl 80 and 150 are commonly used as polyester acrylate oligomer. On the other hand, the monomer is a monomolecule, and the oligomer has a higher molecular weight than the monomer. The role of the oligomer is the sane as the monomer except its weight.

The photo-initiator reacts with ultra-violet ray (UV ray) to generate radical and can be selected from 1-hydroxy-cyclochxyl-phenyl ketone, p-pheny benzo phenone, benayldimethylketal, 2, 4-dimethylthioxanthone, 2,4-diethylthioxanthone, benzoin ethyl ether, benzoin isobutyl ether, 4,4'-diethylaminobenzophenone, p-dimethyl amino benzoic acid ethylester or compound of more than two of these.

The additive agent includes dispersing agent, stabilizer and polymerization prohibiting agent. The dispensing agent includes materials such as surface active agents. The dispersing agent functions to increase the solubility to a solvent of a high-polymer resin when the high-polymer resin is dissolved by a solution during the manufacturing process of the DFR. The stabilizer serves to alleviate a property that the phases of the two components, for example, the high-polymer resin and monomer, are separated. In other words, when the low-polymer material becomes a migration to be projected to surface and thereby the phase-separation of the low-polymer material and the high-polymer material is achieved, the stabilizer improves a compatibility of the high-polymer material and the low-polymer material (oligomer monomer), to thereby prevent the phase-separation of the high-polymer material and the low-polymer material. The polimerization inhibitor prevents a polimerizatjon of materials generated by visible rays or heat.

Figure 3B:
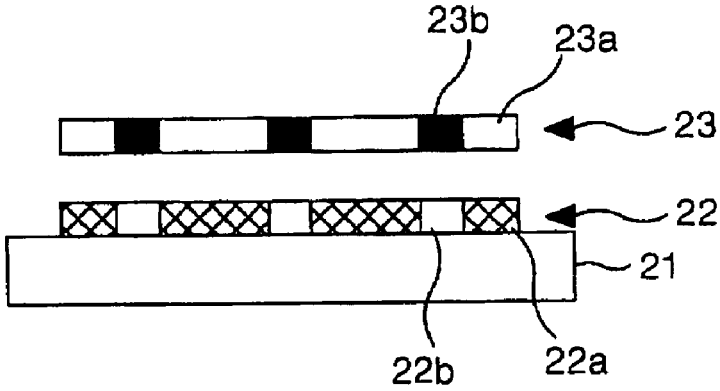

Referring to FIG. 3B, a mask 23 including a light shielding part 23B corresponding to an electrode pattern to be formed and a light transmitting part 24B 23A corresponding to the area other than the electrode pattern is aligned on the photo DFR 22. Subsequently, the method of fabricating electrodes of the PDP according to the embodiment of the present invention exposes the photo-DFR 22 to an ultra violet lamp that irradiates an ultra violet ray of 400~600 ns. The exposure energy applied to the photo-DFR 22 is about 300~700 mm jule/$cm^2$. In this exposure process, the exposed area 22A of the photo-DFR 22 becomes stiff by cross linkage of the reactive monomer, thereby losing the adhesive strength with the substrate. However, the non-exposed area 22B still keeps high adhesive strength by the reactive monomer, thereby having high adhesive strength with the substrate 21.

Figure 2C:
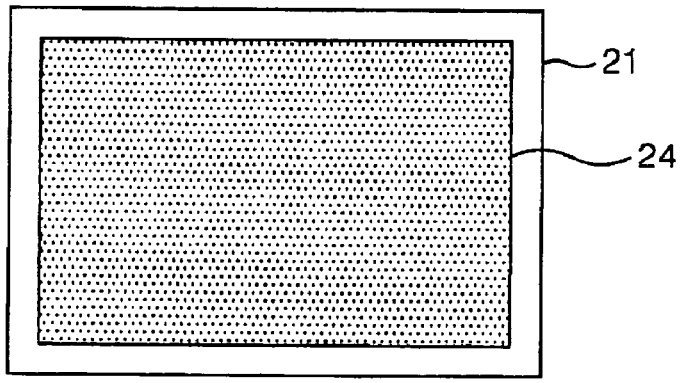
Figure 3C:
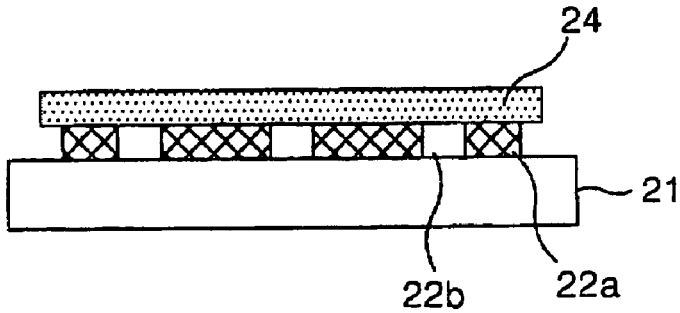

Referring to FIGS. 2C and 3C, in a method of fabricating electrodes of a PDP according to the embodiment of the present invention, an electrode material 24 where silver Ag powder and glass-frit are mixed together is sprayed onto the exposed photo-DFR 22 through a nozzle. The silver AG paste provides the electrode pattern with high conductivity. The glass-frit not only makes the metal powder, i.e., silver powder bonded together, but also makes the adhesive strength between the DFR 22 and the silver powder. The composition of the electrode material layer 24 Is as follows.

TABLE 2

| Silver Ag | Glass-frit |
|---|---|
| 90~99 wt % | 1~10 wt % |

Figure 2D:
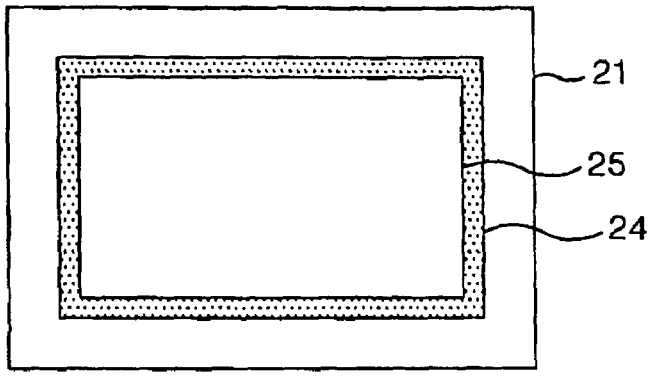
Figure 3D:
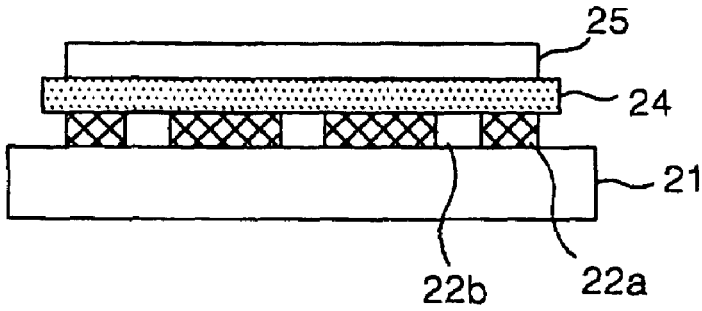

Referring FIGS. 2D and 3D, in a method of fabricating electrodes of a PDP according to the embodiment of the present invention, a peeling DFR 25 to get rid of the electrode material layer unnecessary except the electrode pattern is stuck onto the electrode material layer 24.

The peeling DFR 25 has higher adhesive strength to its lower layer than the exposed area 22A of the DFR 22 and lower adhesive strength than the non-exposed area 22B of the photo DFR 22. The composition of the peeling DFR 25 is as follows in TABLE 3.

TABLE 3

| Binder | Additive |
|---|---|
| 70~80 wt % | 20~30 wt % |

The binder can be organic binder material such as polyurethane, polyester and poly-acrylate, or compound with OH at the end of co-polymer or tri-polymer. The difference between the binder of the peeling DFR 25 and the binder of the photo DFR 22 is that the photo DFR 22 has the carboxylic -COOH within the polymer because it has to go through an alkali development process, but the peeling DFR 25 has more adhesive components since it mainly plays role of adhesive.

The additive includes dispersing agent, stabilizer, tackifler. The tackifier functions to improve a cohesive force between two materials and includes synthesized materials artificially derived from pine resins or chemical formula of the pine resins, or the material such as an ester, an urethane, and an ether.

Figure 2E:
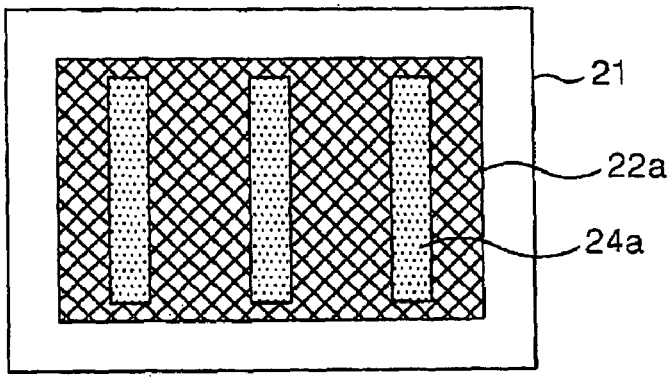
Figure 3E:
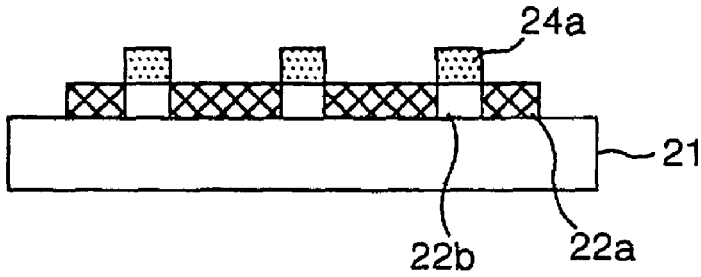

Referring FIGS. 2E and 3E, in a method of fabricating electrodes of a PDP according to the embodiment of the present invention, the peeling DFR 25 is peeled away from the substrate 22 in a mechanical way. Then, because the adhesive strength of the peeling DFR 25 to the electrode material layer 24 is lower than the adhesive strength of the non-exposed area 22B of the photo DFR 22 and higher than the exposed area 22A of the photo DFR 22, the area of the electrode material layer 24 corresponding to the exposed area 22A of the photo DFR 22, the area of the electrode material layer 24 corresponding to the non-exposure area 22A of the photo DFR 22 is taken off along with the peeling DFR 25 when taking off the peeling DFR 25. And the electrode pattern area 24A of the electrode material layer 24 corresponding to the non exposed area 22B of the photo DFR 22 remains intact.

Figure 2F:
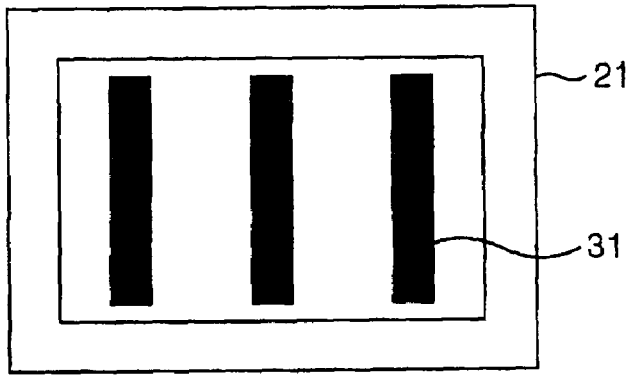
Figure 3F:
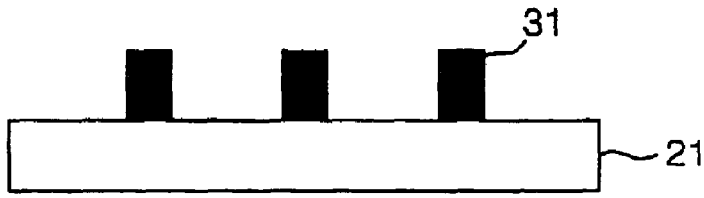

Referring to FIGS. 2F and 3F, in a method of fabricating electrodes of a PDP according to the embodiment of the present invention, the substrate 21 with the electrode pattern area 24A and the photo DFR 22 remaining is heated for 10~60 minutes at about 550~600° C. In this firing process, the binder material and the reactive monomer of the photo DFR 22 is pyrolyzed to be removed, and electrode pattern 31 including silver powder and frit glass only remains on the substrate 21.

As described above, the method of fabricating electrodes of a PDP using the photo peeling method according to the embodiment of the present invention is suitable for forming the electrode pattern of high resolution PDP because the electrode pattern can be highly precise when compared with the related art pattern print method, and its process is environment-friendly, it is easy to recycle the peeled electrode material and its cost can be reduced. Further, the method of fabricating electrodes of a PDP using the photo peeling method according to the embodiment of the present invention does not use wet etching equipment required for the existing wet etching process, thus oxidization of silver is minimized to maximize the conductivity of the electrode of the PDP.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A photo peeling method of fabricating an electrode for a plasma display panel, the method comprising the steps of:

forming a photo material layer on a substrate, wherein the adhesive strength of the photo material decreases when the photo material is exposed to light;

exposing a least one area of the photo material layer to light according to a desired pattern;

forming an electrode material layer on both the exposed area(s) of the photo material layer and the unexposed area(s) of the photo material layer;

forming a peeling material layer on the electrode material layer, wherein the peeling layer has a greater adhesive strength for the electrode material layer than the exposed area of the photo material layer has for the electrode material layer; and removing the peeling material layer to leave the desired pattern of the electrode material layer on the unexposed area(s) of the photo material layer.

2. The method according to claim 1, wherein the the electrode material layer on the exposed area(s) of the photo material layer is removed when removing the peeling material layer.

3. The method according to claim 1, further comprising the step of:

firing the area where the electrode material layer remains after removing the peeling material layer.

4. The method according to claim 1, wherein the photo material layer includes:

binder of 20–50 wt %;

reactive monomer of 40–70 wt %;

photo initiator of 2–5 wt %; and additive of 2–5 wt %.

5. The method according to claim 4, wherein the binder includes at least one of polyurethane, polyester, polyacrylate, co-polymer with carboxylic -COOH and radical OH or tri-polymer with carboxylic -COOH and radical OH.

6. The method according to claim 4, wherein the reactive monomer includes at least one of a multi-functional monomer with 2–5 reactive radicals, acrylic monomer or urethane monomer and oligomer.

7. The method according to claim 4, wherein the photo initiator includes at least one of 1-hydroxy-cyclohexyl-phenyl ketone, p-phenyl benzo phenone, benzyldimethylketal, 2,4-dimethylthioxanthone, 2,4-diethylthioxanthone, benzoin ethyl ether, benzoin isobutyl ether, 4,4'-diethylaminobenzophenone, p-dimethyl amino benzoic acid ethylester.

8. The method according to claim 5, wherein the additive includes at leat one of dispersing agent, stabilizer and polymerization prohibiting agent.

9. The method according to claim 1, wherein the electrode material layer includes:

silver Ag powder of 90–99 wt %; and glass-frit of 1–10 wt %.

10. The method according to claim 1, wherein the peeling material layer includes:

binder of 70–80 wt %; and additive of 20–30 wt %.

11. The method according to claim 10, wherein the binder includes at least one of polyurethane, polyester, polyacrylate, copolymer with radical OH or tri-polymer with radical OH.

12. The method according to claim 10, wherein the additive includes at least one of dispersing agent, stabilizer or adhesive.

* * * * *